United States Patent [19]

Datlof

[11] Patent Number: 4,702,184

[45] Date of Patent: Oct. 27, 1987

[54] QUILTING ALIGNING APPARATUS AND METHOD

[76] Inventor: Donald I. Datlof, 466 Center St., Collingswood, N.J. 08108

[21] Appl. No.: 846,361

[22] Filed: Mar. 31, 1986

[51] Int. Cl.[4] ..... D05B 11/00

[52] U.S. Cl. ..... 112/117

[58] Field of Search ..... 112/117, 118, 119; 226/196, 199; 26/99; 242/76, 75.3

[56] References Cited

U.S. PATENT DOCUMENTS

| | | | |
|---|---|---|---|
| 3,332,827 | 7/1967 | Griffith et al. | 242/76 X |
| 3,393,849 | 7/1968 | Hass | 226/196 X |
| 3,405,884 | 10/1968 | Patterson | 242/76 |
| 3,465,697 | 9/1969 | Gerlach et al. | 112/118 |
| 3,942,735 | 3/1976 | Marchio | 242/76 |
| 4,335,857 | 6/1982 | Pfost et al. | 242/76 |

*Primary Examiner*—Ronald Feldbaum

*Attorney, Agent, or Firm*—Charles F. Duffield

[57] ABSTRACT

Apparatus and method utilized in sewing apparatus for aligning a fabric with multiple needle heads in a sewing operation such as quilting together a backing material, quilting material and cover material having stripes for aligning the stripes with the multiple needle heads of the sewing apparatus consisting of a plurality of crowned split collars selectively positioned along one or more tensioning bars to gather the material for alignment of the stripes with the multiple needle heads.

6 Claims, 5 Drawing Figures

QUILTING ALIGNING APPARATUS AND METHOD

BACKGROUND OF INVENTION

The present invention relates to apparatus and methods for use in aligning fabric with multiple needle heads and, in a specific embodiment, quilting machines for aligning the stripes of the covering material with the needles of the quilting machine.

A conventional quilted composite generally includes a backing material, an intermediate quilting material such as foam rubber or cotton pile and a cover material. The cover material, in many cases, includes stripes running longitudinally of the material.

A conventional quilting machine will include multiple needle heads and usually an upper and lower tensioning bar in advance of the needle heads. The composite material to be quilted is in the form of a roll or bolt of material. The bolt of material is placed upon a supporting bar and the composite positioned under the lower tensioning bar and over the upper tensioning bar and fed into the multiple needle heads.

As the sewing occurs to quilt the material, the thickness of the quilting material will result in compression of the material by the stitching with the resulting consequence that the finished width of the material is less than the width of the beginning material. In a bolt of material of approximately 90 inches in width, the result of the quilting operation will reduce the original width by approximately 2 to 3 inches.

The positioning of the multiple needle heads on the quilting machine is set to the finished width and to be in alignment with the longitudinal stripes of the cover material. Accordingly, as the material is passed from the bolt of material and around the lower and upper tensioning bars, it is necessary to gather the material from its original width down to the finished width and to align the stripes with the needle heads. Presently, this alignment procedure is done by hand and accordingly, it is necessary for one or more individuals to constantly be present at the quilting machine to continuously align and maintain the alignment of the stripes of the bolt of material with the needle heads.

Until the present invention, there does not exist any apparatus or method by which the material may be mechanically gathered for alignment of the stripes with the needle heads.

Another problem faced by the industry is that of pleated or wrinkled fabric from the bolt of material to be sewn. These pleats and wrinkles must presently be straightened and aligned with the needle heads by hand.

SUMMARY OF THE INVENTION

The present invention provides apparatus and method for aligning a material to be sewn with multiple needle heads of a sewing machine. In accordance with the present invention, a plurality of crowned collars are placed along either or both a lower tensioning bar and an upper tensioning bar. As the material passes over the crowned collars, the crown in the collars straightens and/or gathers the material down to a finished width and aligns the material with the needle heads.

DETAILED DESCRIPTION OF INVENTION

Figure 1:
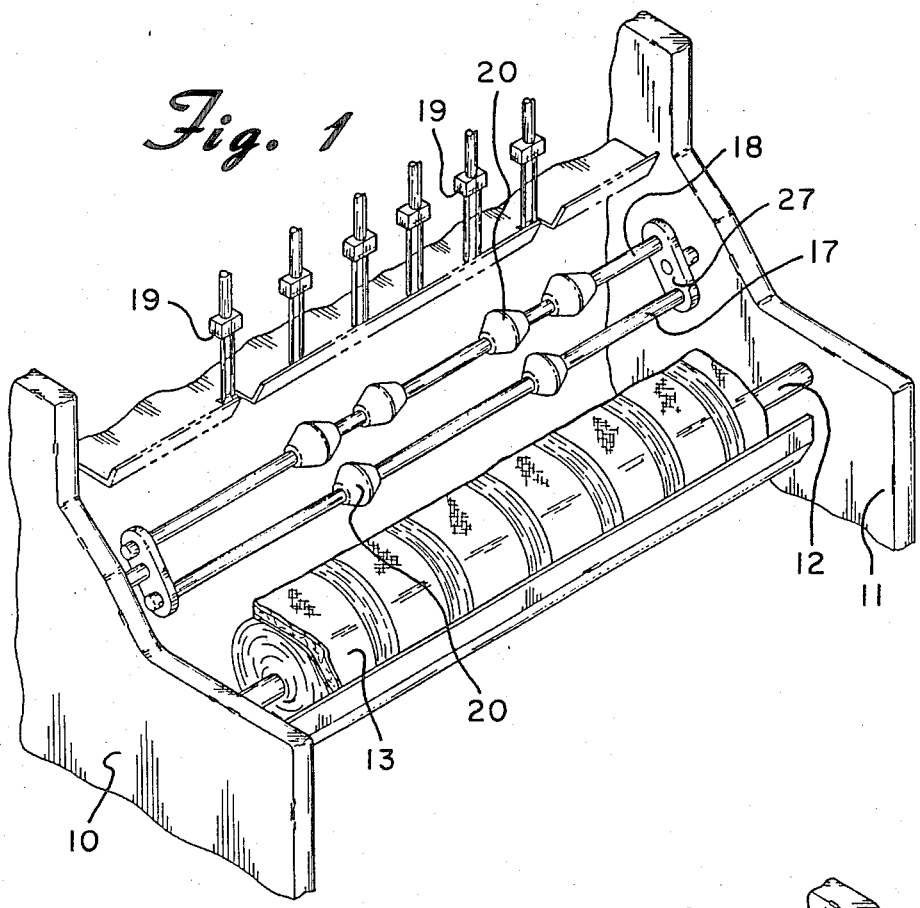
FIG. 1 is a perspective view of a portion of a quilting machine showing the crowned collars of the present invention in place before positioning of a composite material to be quilted.
Figure 2:
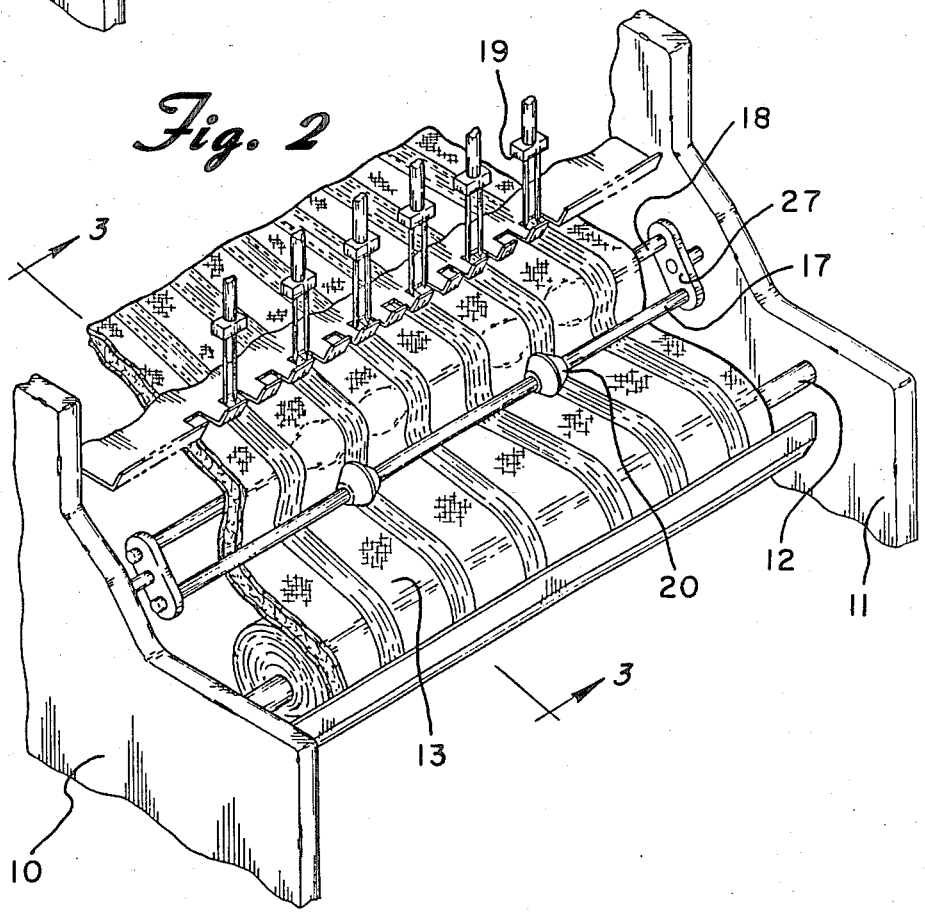
FIG. 2 is a perspective view of a portion of a quilting machine with the composite material in place around the upper and lower tensioning bars and under the multiple needle heads.
Figure 3:
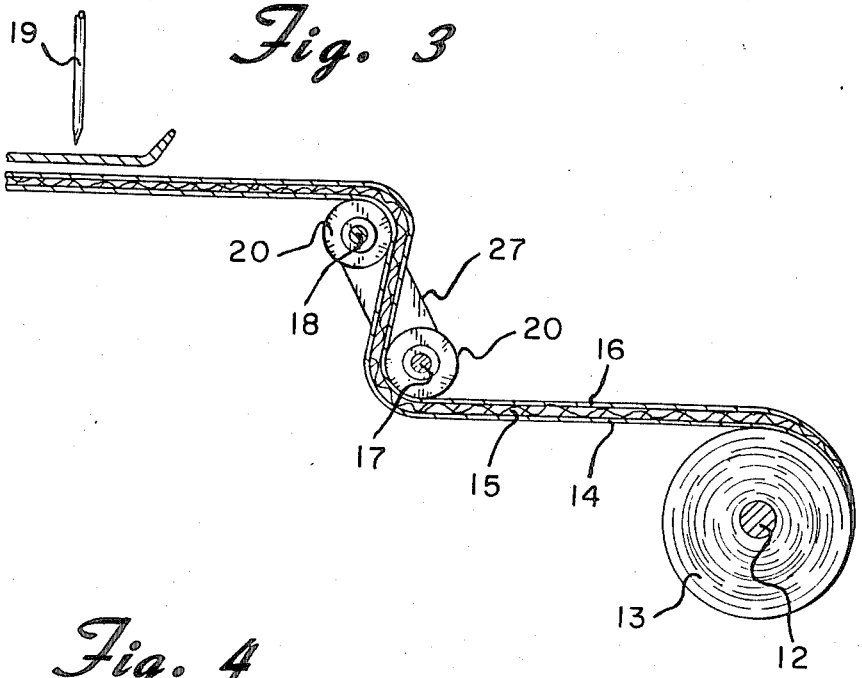
FIG. 3 is a sectional view of the composite material in place around an upper and lower tensioning bar taken along line 3—3 of FIG. 2.

FIGS. 1-3 of the drawings illustrate a portion of a conventional quilting machine to which the apparatus and method of the present invention apply. The quilting machine includes side frames 10 and 11. Secured between the side frames is a material bar 12. The material bar 12 supports a bolt of composite material 13. The composite material generally includes a backing material 14, an intermediate quilting material 15 of foam rubber or fabric pile or the like and a striped cover material 16.

In some quilting machines, there are employed a lower tensioning bar 17 and an upper tensioning bar 18. These bars are supported at each end by a bracket 27 pivotally anchored into the side frames 10 and 11. Rotation of the tensioning bars will vary the amount of the tension upon the material passing over the bars. In use with those machines having tensioning bars, the composite material 13 is positioned under the lower tensioning bar 17 and over the upper tensioning bar 18 and under the multiple needle heads 19.

Figure 4:
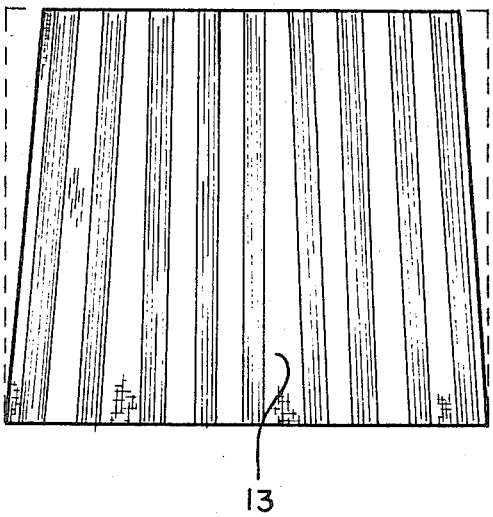
FIG. 4 is a perspective view of a striped composite material illustrating the straightening and gathering effect of the crowned collars.

In operation, either with or without the tensioning bars and as illustrated in FIG. 4, the stitching of the composite material compresses the quilting material with the consequent effect that the material is gathered and the finished width of the material, after quilting, is less than the original width. Most cover material in the composite to be quilted includes longitudinal stripes. The needle heads 19 are positioned from one another to sew along the edges of the stripes. Consequently, since the finished width of the quilting material after quilting is less than the original width prior to the quilting, it is necessary to gather the composite material to bring the stripes into alignment with the needle heads. Heretofore, this has essentially been done by hand and it is necessary for someone to continuously align the composite material as it moves past the needle heads.

Figure 5:
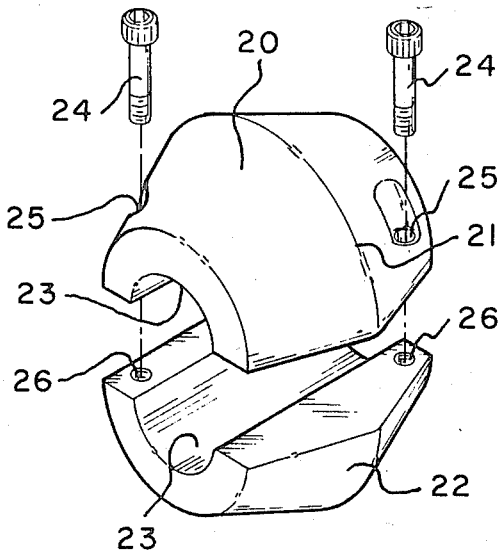
FIG. 5 is an exploded perspective view of the crowned collars of the present invention.

In accordance with the present invention, a plurality of crowned collars 20 are employed upon the upper and lower tensioning bars 18 and 17 respectively. If the tensioning bars are not present in the particular machine involved, they will be retrofitted to the machine in order to practice the present invention. These crowned collars 20 include two half portions 21 and 22 as shown in FIG. 5. Each half portion includes a half bore 23 longitudinally through the half portion. The two half portions 21 and 22 are held together by two or more threaded members 24 which pass through apertures 25 in the half portion 21 and are threaded into threaded apertures 26 in the other half portion 22.

The diameter of the half bore 23 in each half portion 21 and 22 is slightly less than the diameter of the upper and lower tensioning bars 18 and 17 respectively. In this manner, the half portions 21 and 22 can be positioned upon the upper and lower tensioning bars without removal of the bars and secured in place upon the bar at selective positions along the bars by means of tightening down the threaded fasteners 24 into the half portion 22 so as to grip the tensioning bar and maintain the collar stationary in place upon the bar. Where high material tension is required, the bore of the collars 20 can be increased to a size larger than the diameter of the tensioning bars to permit the collars to rotate upon the bars. Suitable tension bar clamps (not shown) may be used to maintain the collar spacing upon the tension bars.

In use, a plurality of crowned collars are placed upon the upper tensioning bar 18 and the lower tensioning bar 17. The composite to be quilted is passed under the lower tensioning bar 17 and over the upper tensioning bar 18 and into the needle heads 19. The crown upon the crowned collars operates to gather the material down to the finished width prior to entrance of the composite into the needle heads. Depending upon the thickness of the composite material, more or less crowned collars can be used as necessary to produce the required gathering effect to align the stripes of the cover material 16 with the needle heads 19.

As the quilting machine operates, the composite is drawn over the stationary crowned collars on the lower and upper tensioning bars 17 and 18 respectively and the composite is continuously gathered and aligned with the needle heads as the material progressively passes through the quilting machine. The crowned collars will continuously and automatically align the composite with the needle heads without the aid of hand aligning by an individual as heretofore.

The collars 20 of the present invention can also be used with tensioning bars to work out wrinkles and pleats in single sheet fabric or base material. As the material passes over the collars, the action of the collars works the material to straighten out the pleats and wrinkles to thus align the fabric with the needle heads.

In a typical quilting situation where the composite material is $\frac{1}{4}$ inches thick and 90 inches wide, the finished quilted width will be approximately 87 inches. In this situation, three crowned collars are used on the upper tensioning bar and two crowned collars on the lower tensioning bar. The collars are 6 inches long and have a minor diameter of $1\frac{1}{8}$ inches and a major diameter of $3\frac{1}{4}$ inches. More or less collars and collars of a greater or lesser crowned diameter may be utilized as conditions require.

The present invention has been described in respect to the particular embodiment shown in the drawings. Other variations and modifications to the present invention will consequently be apparent to those skilled in the art and accordingly, no limitation as to the scope of the invention is intended by the specific embodiment shown but the scope thereof is to be interpreted in accordance with the appended claims.

What is claimed is:

1. In sewing apparatus employing multiple needle heads and two tensioning bars in advance of the needle heads for sewing a base material, the improvement for aligning and/or gathering the material to align the material with the needle heads comprising:

a plurality of crowned members positioned along the tensioning bars in contact with the material.

2. The improvements of claim 1 wherein the crowned members are collars.

3. The improvements of claim 2 wherein the collars include releasable locking means permitting selective positioning along the tensioning bars.

4. The improvement of claim 2 wherein the collars are split longitudinally into half sections and include a bore therein complementary to the tensioning bars and further include means for securing the half sections together whereby the collars can be placed upon the tensioning bar without removal of the bars.

5. The improvement of claim 4 wherein the collars are free to rotate upon the tensioning bars.

6. In sewing apparatus employing multiple needle heads and tensioning bars in advance of the needle heads for sewing a base material, the method of aligning and/or gathering the material for alignment of the material with the needle heads comprising the step of:

positioning along the tensioning bars a plurality of crowned members in contact with the material to work the material for alignment of the material with the needle heads.

* * * * *